United States Patent [19]

Sims et al.

[11] 4,080,115

[45] Mar. 21, 1978

[54] PROGRESSIVE CAVITY DRIVE TRAIN

[75] Inventors: Darrell L. Sims; Kirk R. Shirley, both of Houston, Tex.

[73] Assignee: A-Z International Tool Company, Houston, Tex.

[21] Appl. No.: 726,628

[22] Filed: Sep. 27, 1976

[51] Int. Cl.[2] ..... F01C 1/10; F03C 3/00; E21B 3/12; F16H 1/28

[52] U.S. Cl. ..... 418/48; 175/107; 74/801

[58] Field of Search ..... 418/48, 61 B, 182; 175/107; 74/413, 801; 415/122 R

[56] References Cited

U.S. PATENT DOCUMENTS

| | | | |
|---|---|---|---|
| 1,681,094 | 8/1928 | Capeliuschnicoff | 175/107 |
| 2,473,537 | 6/1949 | McDonald | 175/107 |
| 2,553,548 | 5/1951 | Canazzi et al. | 418/48 |
| 2,615,436 | 10/1952 | Pawl | 418/48 |
| 2,874,534 | 2/1959 | Canazzi | 418/48 |
| 3,288,078 | 11/1966 | Monroe et al. | 418/61 B |
| 3,982,859 | 9/1976 | Tschirky et al. | 418/48 |

FOREIGN PATENT DOCUMENTS

| | | | |
|---|---|---|---|
| 1,403,941 | 1/1969 | Germany | 418/48 |

*Primary Examiner*—John J. Vrablik
*Attorney, Agent, or Firm*—Vinson & Elkins

[57] ABSTRACT

An improved drive train for a progressive cavity device is disclosed. The progressive cavity device has a rotor, a stator, means for fluid to enter between said stator and rotor, and means for fluid to exit therefrom. The rotor is adapted to roll with respect to the stator. The improved drive train comprises means attached to the rotor, for rotation substantially about a single axis, whereby the rolling of said rotor and the rotational motion about said single axis are directly connected and are at different speeds. At least a portion of said means attached to the rotor is aligned with the true center of the rotor.

4 Claims, 8 Drawing Figures

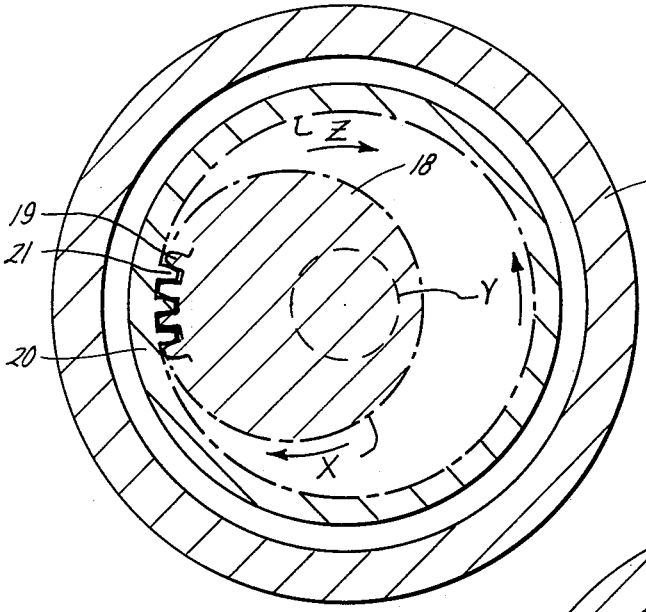
Fig. 2
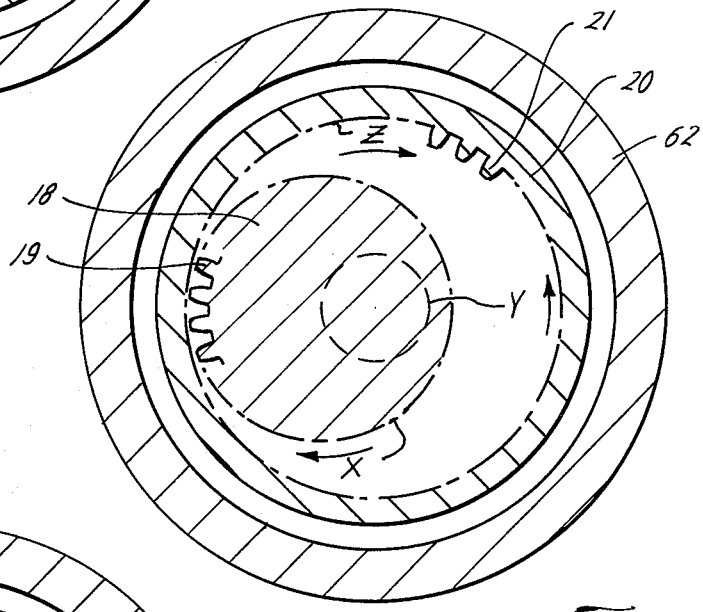
Fig. 4
Fig. 3
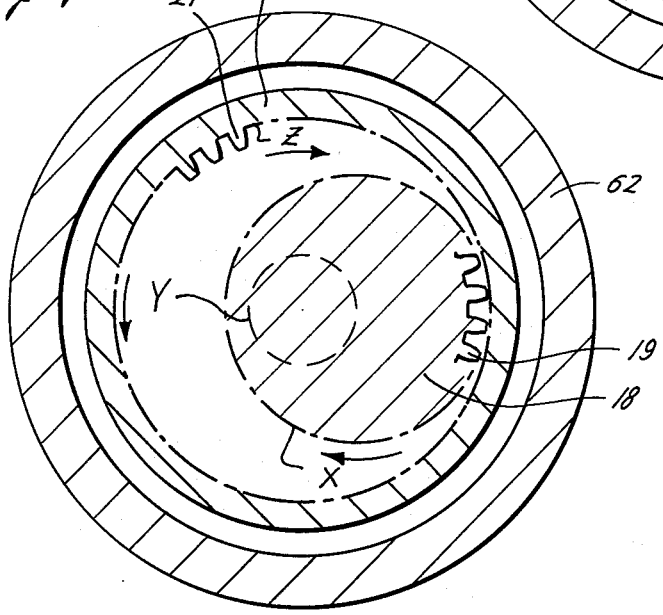

PROGRESSIVE CAVITY DRIVE TRAIN

BACKGROUND OF THE INVENTION

This invention relates to the progressive cavity apparatus, and more particularly to drive trains for progressive cavity devices and to progressive cavity driving, drilling, and pumping apparatus.

Progressive cavity devices are well known in the prior art, both as pumps and as driving motors. These devices are also known as single-screw rotary pumps and single-screw rotary motors. These devices have a single shaft in the shape of a helix contained within the cavity of a flexible lining of a housing. The generating axis of the helix constitutes the true center of the shaft. This true center of the shaft coincides with its lathe or machine center. The lined cavity is in the shape of a double threaded helix with twice the pitch length of the shaft helix. One of the shaft or the housing is secured to prevent rotation; the part remaining unsecured rolls with respect to the secured part. As used in herein, rolling means the normal motion of unsecured part of progressive cavity devices. In so rolling, the shaft and housing form a series of sealed cavities which are 180° apart. As one cavity increases in volume, its counterpart cavity decreases in volume at exactly the same rate. The sum of the two volumes is therefore a constant.

When used as a pump, the unsecured part, whether shaft or housing, is rotated by external forces so as to roll with respect to the secured part. Fluids entering the housing are pumped through it by the progressing cavities. When used as a motor, the unsecured part, whether shaft or housing, rolls with respect to the secured part in response to fluids flowing through the housing. Whether the progressive cavity device is used as a motor or a pump, the part that is unsecured and free to rotate is known generally as the rotor and the secured part is known generally as the stator.

When used as a motor, the unsecured part or rotor produces a rotor driving motion. The driving motion of the rotor is quite complex in that it is simultaneously rotating and moving transversely with respect to the stator. One complete rotation of the rotor will result in a movement of the rotor from one side of the stator to the other side and back. The true center of the rotor will of course rotate with the rotor. However, the rotation of the true center of the rotor traces a circle progressing in the opposite direction to the rotation of the rotor, but with the same speed. Thus, one complete rotation of the rotor will result in one complete rotation of the true center of the rotor in the opposite direction. Thus, the rotor driving motion is simultaneously a rotation, an oscillation, and a reverse orbit.

Examples of progressive cavity motor and pump devices are well known in the art. The construction and operation of such devices may be readily seen in U.S. Pat. Nos. 3,627,453 to Clark (1971); 2,028,407 to Moineau (1936); and 1,892,217 to Moineau (1932).

Despite the simple construction of progressive cavity devices, use of the devices as motors in driving and drilling apparatus has proven difficult. This difficulty stems in part from the complex rotor driving motion described above. Attempts have been made to convert this complex motion into rotational motion for driving or drilling. The most successful device in the past for conversion of this motion has been a universal joint attached to the driving end of the rotor and connected to a universal joint attached to the object to be driven or drill to be rotated. This approach suffers from several disadvantages. First, the universal joint tend to fail quickly if run in abrasive environments. The fluids used in progressive cavity drilling apparatus often are or quickly become abrasive. A further problem encountered with the prior art conversion devices is that the object to be driven or the drill to be operated are driven at the same speed as the rotor. There are many applications where a speed reduction is quite desirable. For example, in drilling oil or gas wells, the rotors of the progressive cavity driving apparatus presently used rotate at speeds approaching 325 revolutions per minute. At this speed, the oil and gas well drill bits being driven tend to wear out far too quickly since they are designed to run at speeds of around 100 to 150 revolutions per minute. This excessive wear on the drill bits also causes difficulty in drilling directional oil and gas wells. Directional wells drilled with progressive cavity drilling devices equipped with prior art conversion devices are slanted at sharp angles since the drill bit can be used for only a limited time. These sharp angles cause problems in drilling and in producing such wells.

Conversely, there are many applications in using progressive cavity devices as pumps where an increase in the speed of the driven rotor over that of the external driving force is desirable. Double universal joints do not provide such an increase in speed.

SUMMARY Applicant has solved the problems associated with the prior art devices by providing means directly connecting the rotational and reverse orbiting motion of the rotor to a rotational motion substantially about a single axis whereby the two motions are at different speeds. The connecting means is attached to the rotor and at least a portion of said means is aligned with the true center of the rotor for rotation substantially about said single axis. When the progressive cavity device is used as a motor, the connecting means attached to the rotor converts the driving motion of the rotor into slower rotational driving motion substantially about a single axis. The rotor driving motion is a rotation, oscillation, and a reverse orbit and the slower speed achieved by such means is at least in part accomplished by utilization of the reverse orbit of the true center of the rotor.

It is therefore an object of this invention to provide an improved drive train for a progressive cavity device whereby the rolling of the rotor and a rotational motion substantially about a single axis are connected to rotate at different speeds.

Another object of this invention is to provide a progressive cavity drilling apparatus which produces a rotational drilling motion substantially about a single axis from the rotor driving motion whereby the rotational drilling motion substantially about a single axis is slower than the rotor driving motion.

A further object of this invention is to provide a progressive cavity drilling apparatus having an increased fluid flow to the drill bit.

Another object of this invention is to provide a progressive cavity pumping apparatus which produces a rotor pumping motion from a rotational driving motion substantially about a single axis whereby the rotor pumping motion is faster than the rotational motion substantially about a single axis.

A further object of the present invention is to provide a progressive cavity driving apparatus which produces a rotational driving motion substantially about a single axis from the rotor driving motion whereby the rotational driving motion substantially about a single axis is slower than the rotor driving motion.

Yet a further object of the present invention is to provide a progressive cavity drilling apparatus that transmits forces between the drill string and the drill bit without exposing the progressive cavity driving device and other components to the loading on the drill bit.

BRIEF DESCRIPTION OF THE DRAWINGS

Other objects, features, and advantageous of the present invention are hereinafter set forth and explained with reference to the drawings wherein:

FIG. 2 is a transverse sectional view taken along line 2—2 in FIG. 1A.

FIG. 3 is a diagrammatic illustration of the elements of FIG. 2 after shaft rotation of 180°.

FIG. 4 is a diagrammatic illustration of the elements of FIG. 2 after a shaft rotation of 360°.

DESCRIPTION OF THE PREFERRED EMBODIMENT

Figure 1:
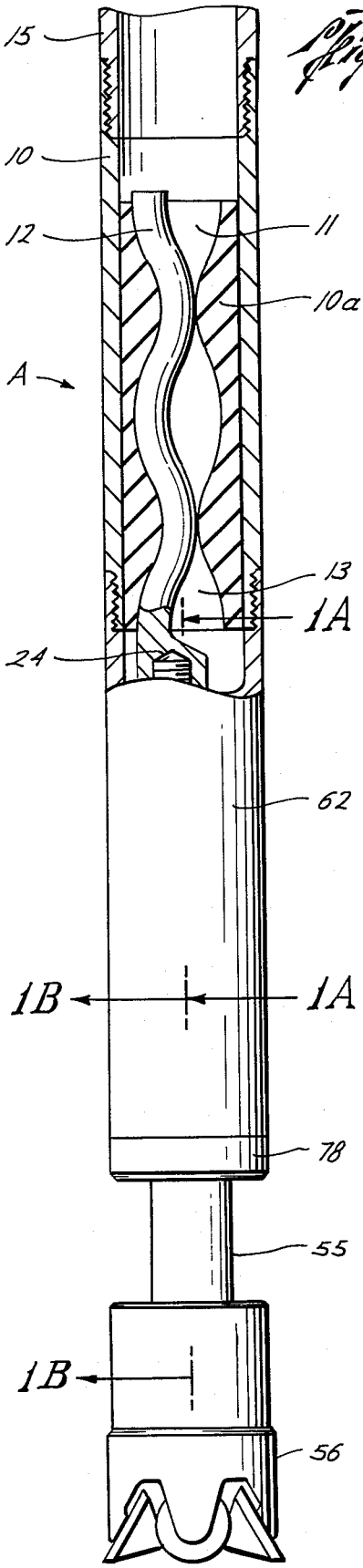
FIG. 1 is an elevation view partly in section of the overall structure of the preferred embodiment of the drilling apparatus.

FIG. 1 shows the overall structure of the preferred embodiment of the improved drive train used in a progressive cavity drilling apparatus. The progressive cavity device A has a stator, a rotor, means for fluid to enter between said stator and said rotor, means for fluid to enter between said stator and said rotor, and means for said fluid to exit therefrom. In the drawings, the housing 10 and its flexible lining 10*a* are held against movement so that they function as the stator in the device A and the shaft 12 functions as the rotor. The housing 10 is tubular and its interior communicates with inlet 11 in the top portion of the lining 10*a* to serve as the means for fluid to enter the progressive cavity device A. Outlet 13 in the bottom portion of the lining 10*a* serves as the means for fluid to discharge from the progressive cavity device A. The shaft 12 is adapted to roll within the lining 10*a*. The progressive cavity device A is attached to the lower end of a drill string 15.

Figure 1A:
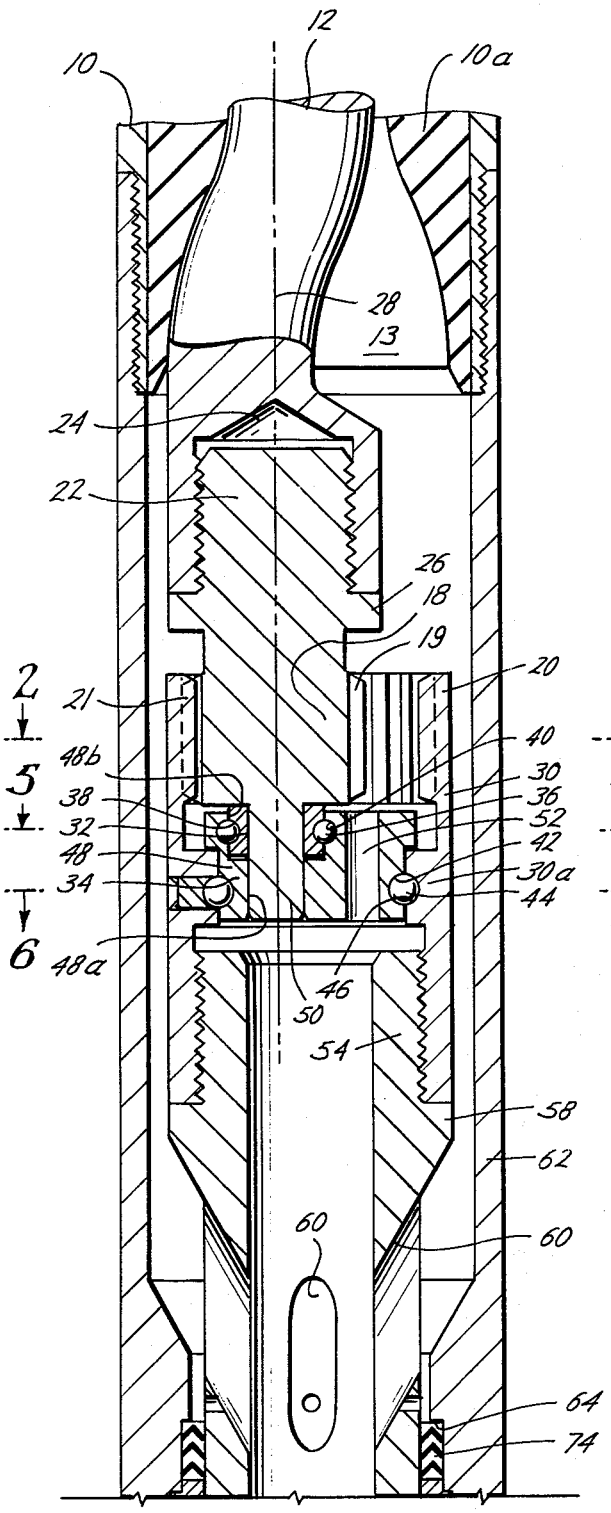
FIG. 1A is a sectional view taken along line 1A—1A in FIG. 1.
Figure 1B:
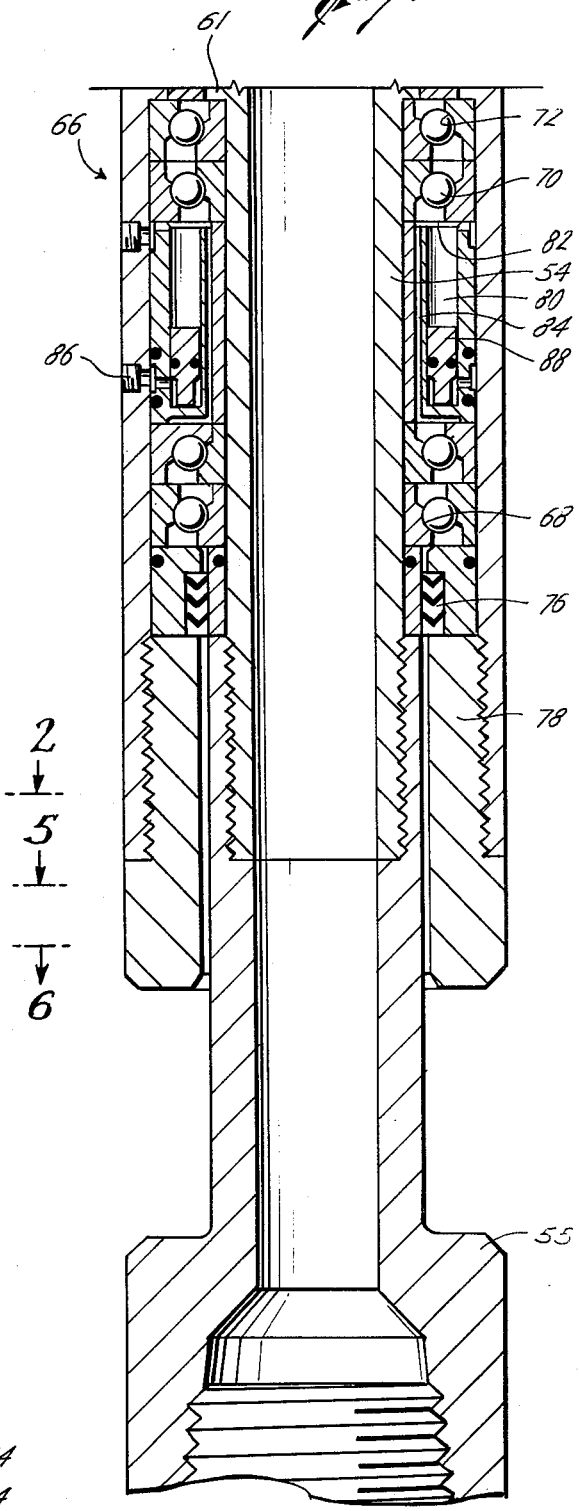
FIG. 1B is a sectional view taken along line 1B—1B in FIG. 1.

Referring to FIG. 1A and FIG. 1, converting means are attached to the rotor 12 with at least a portion of such means aligned with the true center of the rotor for converting the reverse orbiting of the rotor and the rotational motion of said rotor to a rotation about a single axis at a reduced speed. The conversion means or drive train includes a first means attached to the rotor and aligned with the true center of said rotor for rotation therewith and a second means in engagement with the first means for rotation about a single axis. The first means is the pinion 18 and the second means is the ring gear 20 having internal teeth 21 to engage with the teeth 19 of pinion 18. Pinion 18 is mounted on pinion shaft 22. Pinion shaft 22 has external threads at the upper end and is adapted to threadably engage with matching internal threads in recess 24 defined in the lower end of rotor 12. Shoulder 26 on pinion shaft 22 provides a stop engaging the lower end to prevent further threading of rotor 12 when the threaded connection of shaft 22 and rotor 12 is completely made up. Rotor recess 24 is centered about the true center 28 of the rotor 12 so that pinion shaft 22 and thus the pinion gear 18 are aligned with the true center 28 of the rotor when shaft 22 is connected into recess 24. Ring gear 20 is mounted on the upper end of a ring gear sleeve 30. The lower end of said sleeve is fitted with internal threads.

When the progressive cavity device and improved drive train is used as driving apparatus as it is in the drilling apparatus described herein, the rotor 12 responds to the flowing fluid to produce a rotor driving motion which is simultaneously a rotation, an oscillation, and a reverse orbit. The means attached to the rotor 12 and aligned with the true center 28 of the rotor described above converts this rotor driving motion into slower rotational driving motion substantially about a single axis. The reduction in speed of this slower rotational driving motion is at least in part accomplished by utilization of said reverse orbit to reduce the speed of rotation of the rotor 12. The pinion 18 is attached to the rotor 12 and aligned with the true center 28 of the rotor 12, and is in driving engagement with the ring gear 20 for producing said slower rotational driving motion substantially about a single axis. The ring gear 20 has internal teeth and is adapted to be engaged and rotated at a reduced speed by the pinion 18 when rotated by the rotor 12.

Figure 5:
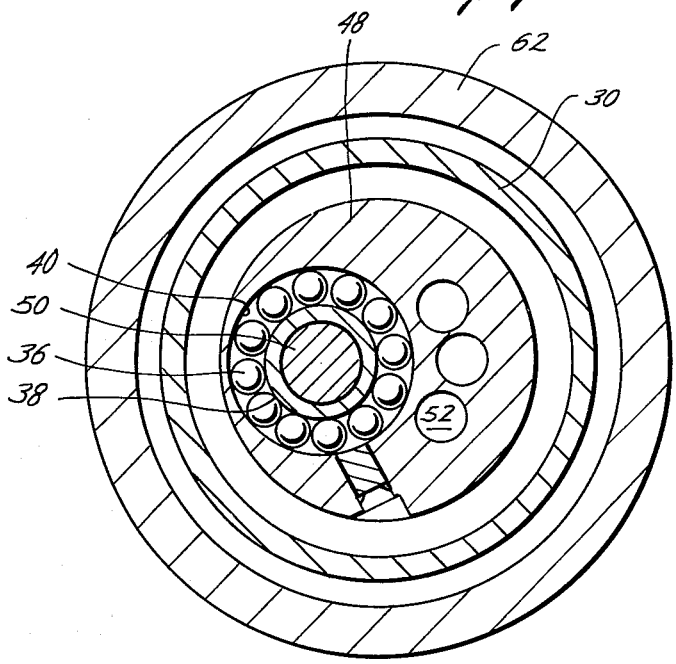
FIG. 5 is a transverse sectional view taken along line 5—5 in FIG. 1A.
Figure 6:
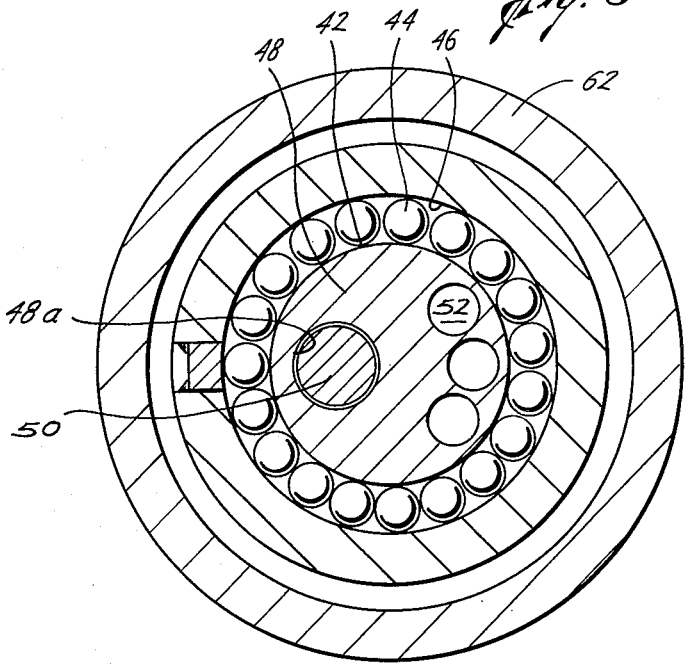
FIG. 6 is another transverse sectional view taken along line 6—6 in FIG. 1A.

Referring to FIGS. 5 and 6 as well as FIG. 1A, pinion bearing means 32 and ring gear bearing means 34 are provided to insure proper engagement and alignment of the ring gear 20 with the pinion 18 and to provide support for and allow relative rotation of the two gears. Additionally, the bearings hold the rotor 12 and stator 10 in correct alignment throughout the life of the progressive cavity device A. The bearings may be constructed to be lubricated by the fluid driving the rotor 12. The pinion bearing means 32 includes ball bearings 36, inner bearing race 38, and outer bearing race 40. The ring gear bearing means 34 comprises inner bearing race 42, ball bearings 44, and outer bearing race 46. The pinion bearing outer bearing race 40 and ring gear bearing inner race 42 are formed as annular grooves in the annular body 48 having a generally semi-circular cross-sectional shape. The body 48 has an eccentric bore 48*a* and a counterbore 48*b* which are offset from the center of body 48. Pinion bearing means 32 are set in the counterbore 48*b* and the extension 50 of the shaft 22 is received in the bore 48*a* as shown. Extension 50 is aligned with the true center 28 of the rotor 12. The function of the extension 50 is to cooperate with the body 48, pinion bearing means 32, and ring gear bearing means 34 to maintain driving engagement between pinion 18 and ring gear 20. The ring gear bearing outer race 46 is defined in the inner annular flange 30*a* on sleeve 30. Body 48 defines openings 52 which allow fluid communication from above to below the body 48.

Tubular member 54 connects to sleeve 30 and transmits the slower rotational motion substantially about a single axis of the ring gear 20 through a bit sub 55 to the drill bit 56. Member 54 is threaded at its upper end to engage the threads on the lower end of ring gear sleeve 30. Shoulder 58 provides a stop for the engagement of the ring gear sleeve 30 and member 54. The plurality of ports 60 extend through member 54 to provide fluid communication from the exterior of members 54 to its interior. Shoulder 61 on the exterior of member 54 below ports 60 faces downward. The lower end of ring member 54 is threaded for engaging the threads on bit sub 55 which is threaded to drill bit 56. The interior of member 54 is in fluid communication through bit sub 55 with the interior of the drill bit 56 so that drilling fluid flows through drill string 15, device A, member 54, and sub 55 into drill bit 56. This arrangement provides for an increased fluid flow to the drill bit 56.

Drive train housing 62 threadably engages the threads on the lower end of the device housing 10. The drive train housing 62 has a sufficiently large inside diameter to define an annulus between its interior wall and the ring gear sleeve 30. This annular opening allows fluid communication around the ring gear sleeve 30. The interior of housing 62 defines the downwardly facing stop shoulder 64 below the level of the openings 60 in the ring gear extension 54.

Thrust bearing means 66 are positioned in the annular space located below the shoulder 64 and shoulder 61 between member 54 and drive train housing 62. Thrust bearing means 66 allow free rotation of the member 54 with respect to the drive train housing 62. The thrust bearing means 66 includes four bearings each including an inner bearing race 68, ball bearing 70, and outer bearing race 72. This arrangement of the thrust bearings results in the drill string weight being transmitted through the thrust bearing means 66 directly to the drill bit 56 to isolate without acting upon the flexible lining of the housing 10, rotor 12, pinion gear 18, ring gear 20, pinion bearings means 32, and ring gear bearing means 34. Forces moving upwardly from the drill bit 56 are likewise transmitted through the thrust bearing means 66 directly to the drill string 15 without acting upon the above mentioned parts. One of the thrust bearings accepts the rotor load when the drill bit 56 is running free with no contact with the bottom of the hole. Thus, the thrust bearing means 66 serve to transmit forces between the drill string and the drill bit 56 whereby the flexible lining 10*a* of the stator 10, the rotor 12, pinion 18, ring gear 20, pinion bearing means 32, and ring gear bearing means 34 are isolated from the loading on the drill bit 56.

To prevent abrasion to the thrust bearing means 66 from foreign matter, sealing means are provided above and below the thrust bearing means 66. The upper seal 74 preferably is located in the annular space between the shoulder 64 on the drive train housing 62 and the tubular member 54. Thus the upper seal 74 is above the uppermost one of the four thrust bearings 66. The lower seal 76 is located below the lowest of the thrust bearings 66 in the annular space between the tubular member 54 and the drive train housing 62. An annular plug 78 is provided with external threads to threadably engage internal threads on the lower end of the drive train housing 62 to hold the lower seal 76, outer thrust bearing races 72, and upper seal 74 in place below the flange 64 on the drive train housing 62. This tightly compacts and actuates the upper seal 74 and the lower seal 76. The annular plug 78 surrounds member 54 and the upper end of drill bit sub 55. The drill bit sub 55 also serves to hold the inner thrust bearing races 68 in place below the shoulder 61.

Means for lubricating the thrust bearing means and sealing means are provided, preferably between the two upper and the two lower thrust bearing means 66. The means for lubricating may be an annular lubricating reservoir 80 located between the member 54 and the drive train housing 56. Said lubrication reservoir 80 communicates with the thrust bearing means 66 and the sealing means 74, and 76 to provide a continuous supply of lubrication to said thrust bearing means and said sealing means. Communication of the lubrication reservoir 80 with the two upper thrust bearing means is accomplished by an annular lubrication passage 82 located between said reservoir 80 and said upper thrust bearing means. Communication of the lubrication reservoir 80 with the two lower thrust bearing means is accomplished by an annular lower lubrication passage 84 located between and communicating with the upper lubrication passage 82 and the lower thrust bearing means. In the preferred embodiment, the lower lubrication passage 84 passes longitudinally between the member 54 and the lubrication reservoir 80.

Since some small amount of lubrication may leak through the upper seals 74 and the lower seals 76, which lubrication would, unless prevented, be replaced by abrasive foreign matter, means is provided for exerting external pressure on the lubricating substance in the lubrication reservoir 80 to maintain lubrication of the thrust bearing means 66 and the sealing means. In the preferred embodiment, this means is an opening 86, communicating between the annulus of the well bore through the drive train housing 62 to the interior of the lubrication reservoir 80. An annular piston 88 is position within the lubrication reservoir 80 between the lubricating substance and opening 86. External pressures in the well bore are communicated through the opening 86 to the piston 88 which in turn exerts a pressure on the lubricating substance in the lubrication reservoir 80 to provide a continuous supply of lubrication to the thrust bearing means and sealing means and to balance pressures on the lubrication system.

The preferred operation of a progressive cavity device and improved drive train used as a drilling or driving apparatus begins with a fluid flow through inlet 11 in the housing 10 thereby contacting the rotor 12. Responsive to the flow of this fluid, the rotor 12 rotates the pinion 18 which is attached to the rotor and aligned with its true center 28. The pinion 18 in turn rotates the freely rotatable ring gear 20 at a slower rate than the rotor driving motion.

As shown in FIGS. 2, 3 and 4, the rotation and orbit of pinion 18 in contact with ring gear 20 reduces the speed of the rotor driving motion by a factor of three. For simplicity, only three of the ring gear teeth 21 and four of the pinion gear teeth 19 are shown. When the rotor 12 and pinion 18 have turned 180° in the direction "X", and the pinion 18 has orbited 180° in the opposite direction or direction "Y", the ring gear 20 has been turned the direction "Z" one-sixth of a revolution or 60°. As shown in FIG. 4, when the rotor 12 and pinion have turned 360° and the pinion 18 has orbited 360° in the reverse direction, the ring gear 20 has been turned in the direction "Z" one-third of a revolution or 120°. While any reduction of speed may be accomplished by changing the number of teeth in pinion 18 and ring gear 20, it is preferred for oil and gas well drilling to reduce the speed of the rotor driving motion by at least one-half. The slower rotational driving motion of the ring gear 20 is substantially about a single axis and is transmitted to the drill bit 56 through ring gear sleeve 30, tubular member 54, and bit sub 55. The pinion bearing means 32 and ring gear bearing means 34 support the pinion 18 and ring gear 20 for free rotation and maintain their proper alignment. The bearings also accept the rotor thrust and maintain proper rotor-stator alignment.

The thrust bearing means 72 transmit forces between the drill string 15 and the drill bit 56 so that the flexible lining of the stator 10, the rotor 12, pinion gear 18, ring gear 20, pinion bearing means 32, and ring gear bearing means 34 are isolated from the loading on the bit.

The fluid that is discharged from outlet 13 divides into two streams. The smaller of the two streams flows into the ring gear sleeve 30 and lubricates the pinion bearings 32 and ring gear bearings 34. The fluid from this stream flows through the openings 52 in the body 48 to the interior of the member 54. The larger second stream of fluid enters the annular space between the ring gear sleeve 30 and the drive train housing 62. The fluid flows from such annular space through member 54, through ports 60 and merges with the smaller first stream to flow through the interior of the member 54 to the drill bit 56.

From the foregoing it can be seen that the improved drilling apparatus of the present invention includes a progressive cavity driving apparatus and improved drive train which overcomes several disadvantages found in the prior art systems.

The improved drive train may of course be used in a progressive cavity pumping apparatus. The progressive cavity device would again have a rotor, a stator, means for fluid to enter between said rotor and said stator, and means for fluid to exit therefrom. It is preferred that the housing and its flexible lining be the stator and the shaft be the rotor, with the rotor being adapted to roll within the housing so as to produce a rotor pumping motion. Means are attached to the rotor, at least a portion of which is aligned with the true center of the rotor, for rotation substantially about a single axis, whereby the rotor is driven by said rotation. The means attached to the rotor produces a faster rotor pumping motion from the rotational motion of said means substantially abut a single axis, moving the fluid in response to the rotor pumping motion. The faster rotor pumping motion is a rotation, oscillation, and a reverse orbit. Thus it is evident that a progressive cavity pumping apparatus and improved drive train has been described which overcomes several disadvantages found in the prior art systems.

While the invention has been particularly shown and described with reference to the preferred and alternative embodiments thereof, it will be understood by those skilled in the art that various changes in size, shape, material and in the details of this illustrated construction may be made within the scope of the appended claims without departing from the spirit of the invention.

What is claimed is:

1. A driving apparatus, comprising a progressive cavity driving device having a stator, a cavity within said stator, a rotor within said stator cavity, and means for flowing fluids through said stator, said rotor producing a rotor driving motion responsive to the flow of fluids through said stator cavity, a pinion secured on the end of said rotor projecting from the fluid discharge end of said stator, a housing, a ring gear secured on said housing having internal teeth in engagement with said pinion whereby flow of fluids through said driving device rotates said housing with respect to said stator, means sealing said housing to said stator whereby all fluid flow through said stator is directed through said housing, and bearing means in said housing for supporting said pinion and said rotor to positively retain said pinion in engagement with said ring gear.

2. The apparatus according to claim 1, including a drill bit secured to said housing, rotation of said housing imparting a rotary drilling motion to said drill bit.

3. The apparatus according to claim 1 wherein said bearing means defines a fluid flow passageway therethrough whereby fluids flowing through said housing are not partially trapped between said pinion and said ring gear.

4. A drilling apparatus comprising, a drill string;

a progressive cavity device connected to the lower end of said string and having a stator, a rotor within said stator, and means for flowing fluids through said stator to drive said rotor;

a pinion attached to said rotor and having its axis aligned with the true center of said rotor for rotation therewith;

a ring gear in engagement with and driven by said pinion; at a speed less than the speed of rotation of said pinion;

a drill bit having a tubular housing connected to said ring gear for rotation with said ring gear whereby the rotor rotation is converted to rotational drilling motion about an axis displaced from and parallel to said rotor axis, first bearing means supporting a bearing body within said drill bit housing, and second bearing means offset in said bearing body in supporting engagement with said pinion and said rotor and said bearing body having a fluid passageway therethrough so that fluid discharge from said driving device which flows within said ring gear is delivered through said bearing body to said drill bit.

* * * * *